US006217388B1

(12) United States Patent
Francis

(10) Patent No.: US 6,217,388 B1
(45) Date of Patent: Apr. 17, 2001

(54) LOW PROFILE SIR CONNECTOR AND TERMINAL

(75) Inventor: Michael E. Francis, Beaver Falls, PA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/498,025

(22) Filed: Feb. 4, 2000

(51) Int. Cl.[7] ..... H01R 13/66
(52) U.S. Cl. ..... 439/620; 439/352; 439/942
(58) Field of Search ..... 439/620, 352, 439/942

(56) References Cited

U.S. PATENT DOCUMENTS 5,241,910 * 9/1993 Cunnungham et al. ..... 439/608
5,314,345 * 5/1994 Chaly et al. ..... 439/188
5,514,006 * 5/1996 Getselis et al. ..... 439/417
5,586,902 12/1996 Hopf et al. .
5,853,298 12/1998 Pacher .
5,876,231 3/1999 Pacher .

* cited by examiner

*Primary Examiner*—Neil Abrams
*Assistant Examiner*—Phuong Dinh
(74) *Attorney, Agent, or Firm*—Richard A. Jones

(57) ABSTRACT

An electrical connector for use in an SIR system comprises a connector housing which has a plug portion with a filter cavity disposed therein. A filter element which has a pair of longitudinally disposed receptacles is disposed within the filter cavity. The connector also has a pair of terminals each of which has a barrel portion that is disposed within each of the receptacles within the filter element and a perpendicular crimp portion. A retaining cap which has a connector position assurance portion (CPA) and a cover portion connected by a pair of flexible straps is fastened to the connector housing to align and retain the terminals within the connector housing. The terminals have a U-shaped transition area that allows for a smaller terminal.

9 Claims, 3 Drawing Sheets

LOW PROFILE SIR CONNECTOR AND TERMINAL

TECHNICAL FIELD

The present invention relates to matable electrical connection systems, and more specifically, to an electrical connector for use in a supplemental inflatable restraint (SIR) system.

BACKGROUND OF THE INVENTION

It is well known in the art to provide a supplemental inflatable restraint (SIR) system for the protection of vehicle occupants. A typical SIR includes a housing, an airbag normally stored in the housing, and an inflator for discharging gas to inflate the airbag. Typically, the inflator is activated in response to a predetermined amount of vehicle deceleration.

It is known to mount an air bag of a SIR system in an instrument panel, a door panel, as well as within a steering wheel. Air bag inflation in triggered by a device known as an initiator. The initiator is connected to an electrical connector which is operatively coupled to a pair of wires leading from a controller. The space available for an airbag is generally limited, especially for steering wheel mounted air bags. Therefore, it is desirable to minimize the size of any component within a SIR system, including the electrical connector.

U.S. Pat. No. 5,586,902 to Hopf et al, discloses an electrical connector for coupling wires to an initiator. The '902 patent teaches a connector having a pair of 90° terminals coupled to wires leading through a ferrite filter element disposed longitudinally within a connector housing. The geometry of the connector of the '902 patent requires the wires to be inserted through the filter element before being crimped to the 90° terminals. Although the '902 patent discloses a good electrical connector for an SIR system, it has a number of deficiencies. The location of the filter element results in a larger connector that requires more space. Furthermore, the location of the filter element substantially burdens the manufacturing process of the connector.

Therefore, it is desirous to provide an electrical connector for an SIR system having a reduced size. It is further desirous to provide an electrical connector for an SIR system which allows more efficient manufacturing of the connector and its components.

SUMMARY OF THE INVENTION

An object of the present invention is to provide an electrical connector for use in a SIR system having a controller and an initiator comprising a connector housing which has a plug portion with a filter cavity disposed therein. A pair of apertures are disposed within the plug portion of the connector housing which are in communication with the filter cavity. A filter element is disposed within the filter cavity. The filter element has a pair longitudinally disposed receptacles, which when installed in the filter cavity align with the pair of apertures. A pair of terminals, each of which has a barrel portion and a crimp portion, are disposed within the connector housing. The crimp portion is provided to receive a wire leading from the controller. The barrel portions of each terminal is disposed within one of the receptacles within the filter element, whereby the barrel portions are aligned with the pair of apertures so is to receive initiator pin terminals.

A feature of the present invention is that the connector housing has a reduced size as a result of locating the filter element within the plug portion of the connector housing.

Another feature of the present invention is that the barrel portions of the terminals are located within the filter element to reduce the cost of producing an SIR system. By locating the barrel portions of the terminals in receptacles of the filter element, the terminals may be processed on automatic cutters. Furthermore, installation of the filter element into the connector housing may be automated as well.

Another feature of the present invention is the connector housing has a wire shelf portion which has a pair of laterally disposed wire channels for guiding each of a pair of wires to one of the pair of terminals.

Another feature of the present invention is that the connector housing articulates with a retaining cap which has a connector position assurance (CPA) portion and a cover portion connected by a pair of flexible straps.

Another object of the present invention is to provide a method for assembling an electrical connector for use in a SIR system having a controller and an initiator, comprising the steps of providing a connector housing which has a plug portion with a filter cavity. The housing also has a pair of apertures disposed within the plug portion, and in communication with the filter cavity. The filter element has a pair of longitudinally disposed receptacles inserted within the filter cavity, where each of the receptacles are aligned with one of the pair of apertures. A pair of terminals having a barrel portion disposed generally perpendicular to crimp portion is also provided. The crimp portion of the terminal is crimped to a wire. Each of the terminals are inserted in the housing where the barrel portion of each of the pair of terminals is inserted into each of the pair of receptacles within the filter element.

It is another object of the present invention to provide a terminal for an electrical connector, comprising a barrel portion generally perpendicular to a crimp portion, the barrel portion having a contact end and a open end that is adjacent to the crimp portion. The barrel portion is provided to receive a pin terminal, while the crimp portion is provided to receive and secure the terminal to a wire. A generally U-shaped terminal transition area is disposed between the barrel portion and the crimp portion. The terminal transition area has a smaller diameter section, a neck down portion and a formed transition. The neck down portion is disposed between the open end of the barrel portion and the smaller diameter section. The formed transition is disposed between the smaller diameter section and the crimp portion. A position tab is disposed adjacent to the barrel portion for locating the terminal within the electrical connector.

Other objects and features of the present invention will become apparent to those skilled in the art in light of the following detailed description of the preferred embodiment of the present invention, setting forth the best mode of the invention contemplated by the inventors and illustrated by the accompanying sheets of drawings.

DETAILED DESCRIPTION OF THE PREFERRED EMBODIMENT

Figure 1:
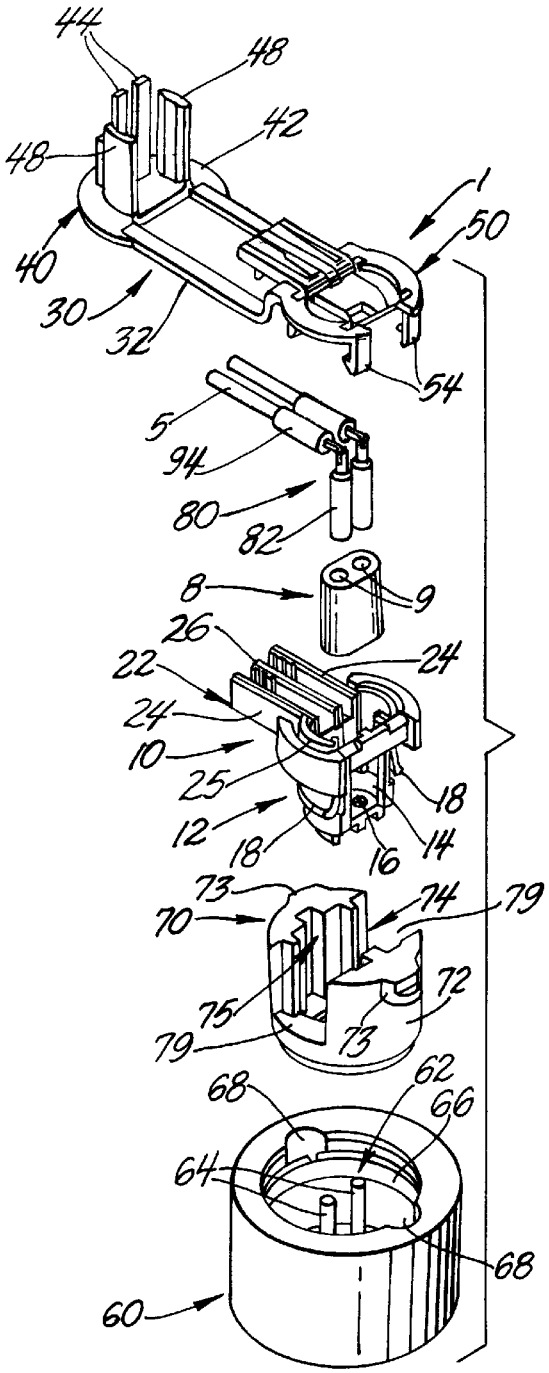
FIG. 1 is an exploded isometric view of the electrical connector of the present invention.

Referring now to the drawings, and more particularly to FIG. 1, a connector 1 is shown in an exploded isometric view. The connector 1 comprises a connector housing 10 which has a plug portion 12 and wire shelf portion 22. A filter cavity 14 is disposed within the plug portion 12 along a vertical axis.

A filter element 8 is provided and disposed within the filter cavity 14. A pair of apertures 16 extend through the wall of the plug portion 12 of the connector housing 10 at the bottom of the cavity 14 so that the apertures 16 are in communication with the filter cavity 14. The filter element 8 has a pair of longitudinally disposed receptacles 9 that are aligned with the pair of apertures 16 when the filter element 8 is disposed within the filter cavity 14.

Figure 5:
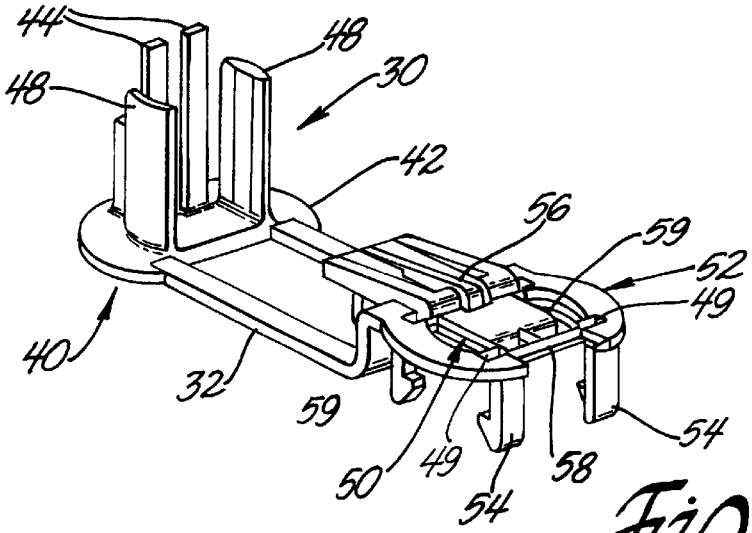
FIG. 5 is an isometric view of a retaining cap shown in FIG. 1.
Figure 6:
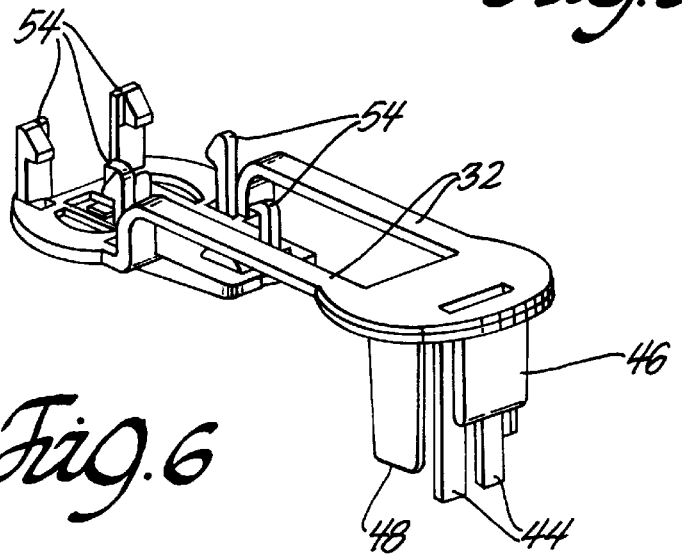
FIG. 6 is an upside-down isometric view of the retaining cap shown in FIG. 5.

Referring now to FIG. 5 a retaining cap 30 having a connector position assurance (CPA) portion 40 and a cover portion 50 is shown in an isometric view. The CPA portion 40 is attached to the cover portion 50 by a pair of flexible straps 32. A plurality of lock arms 54 extend from the cover portion 50 to fasten the retaining cap 30 to the connector housing 10.

Figure 2:
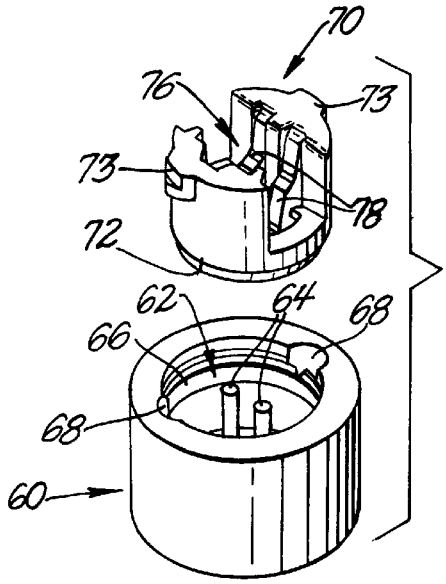
FIG. 2 is an isometric view of a shorting clip assembly shown in FIG. 1.

The CPA portion 40 has a pair of disengagement tabs 44 extending from a CPA body 42. Referring now also to FIG. 2, a shorting clip assembly 70 is shown. The pair of slots 79 cooperate with a pair of alignment tabs 48 extending from the CPA body 42 of the retaining cap 30. The shorting clip assembly 70 includes a shorting clip housing 72 which has a shorting clip cavity 74 with a pair of slots 79. A shorting clip 76 which has a pair of tabs 78 is disposed within the shorting clip cavity 74.

The shorting clips assembly 70 mates with an initiator 60 which has a socket portion 62 for receiving the shorting clip housing 72. The initiator 60 has a pair of initiator pins 64, also referred to herein as terminal pins 64 extending within the socket portion 62.

Figure 4:
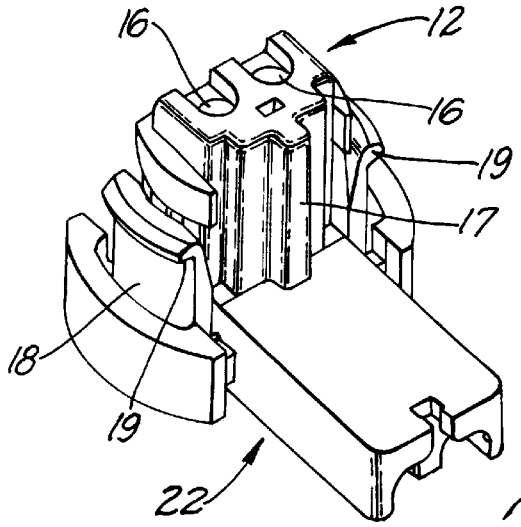
FIG. 4 is an upside-down isometric view of the connector housing shown in FIG. 3.

The initiator 60 has a groove 66 that cooperates with a ridge 19 formed at the perimeter of a pair of retaining tabs 18 which can be seen in FIG. 4. An index rib 17 disposed along the plug portion 12 aligns the connector housing 10 with the shorting clip housing 72. The shorting clip assembly 70 is inserted into the socket portion 62 of the initiator 60. The terminal pins 64 project into the shorting clip cavity 74 where contact is made with the shorting clip 76, thereby providing a shunt between the initiator pins 64.

The plug portion 12 of the connecting housing 10 engages shorting clip housing 72. The index rib 17 aligns the connector housing 10 to the shorting clip assembly 70 by cooperating with an index groove 75 disposed within the shorting clip housing 72.

The connector housing 10 is secured to the shorting clip housing 72 by locking the ridges 19 formed at the perimeter the retaining tabs 18 into the groove 66 within the initiator 60. The receptacles 9 within the filter element 8 disposed within the plug portion 12 of connector housing 10 are aligned with the initiator pins 64. The barrel portion 82 of each of the pair of terminals 80 engages each of the pair of receptacles 9 to contact the initiator pins 64. Each wire 5 is connected to a crimped portion 94 of one of the terminals 80. The wire shelf portion 22 of the connector housing 10 has a pair of wire channels 24 separated by a longitudinal rib 26. A plurality of retaining ribs 28 are disposed within wire channels 24 for retaining and strain relieving wires 5 during assembly and operation of the connector 1.

The retaining cap 30 is fastened to the connector housing 10 by the plurality of lock arms 54. Referring now also to FIG. 5, the pair of flexible straps 32 permit the CPA portion 40 of the retaining cap 30 to fold over and engage the cover portion 50. A lock 46 fastens the CPA portion 40 to the connector housing 10. The alignment tabs 48 pass through a pair of alignment tab apertures 59 disposed within the cover portion 50 as well as another pair of alignment tab apertures 25 disposed within the connector housing 10. The alignment tabs 48 interlock with the pair of slots 79 at the opposite sides of the shorting clip housing 72. The shorting clip housing 72 is aligned with the initiator 60 by engaging a pair of notches 68 disposed in the initiator 60 with a pair of tabs 73 extending from the perimeter of the shorting clip housing 72. By facilitating alignment between the CPA portion 40 and the shorting clip housing 72, proper alignment of the connector housing 10 and the initiator 60 is achieved.

A pair of disengagement tabs 44 extend from the CPA body 42 and pass through a pair of disengagement tab apertures 49 disposed within the cover body 52 when the CPA body 42 engages the cover portion 50. The disengagement tabs 44 disconnect the shorting clip 76 from the initiator pins 64 when the CPA portion 40 folds over and engages the cover portion 50, rendering the CPA portion 40 in a locked position. A spring arm 56 is operatively attached to the cover portion 50 and is in contact with the longitudinal rib 26 when the retaining cap 30 is connected to the connector housing 10. The spring arm 56 provides tension to prevent rattling.

Figure 7:
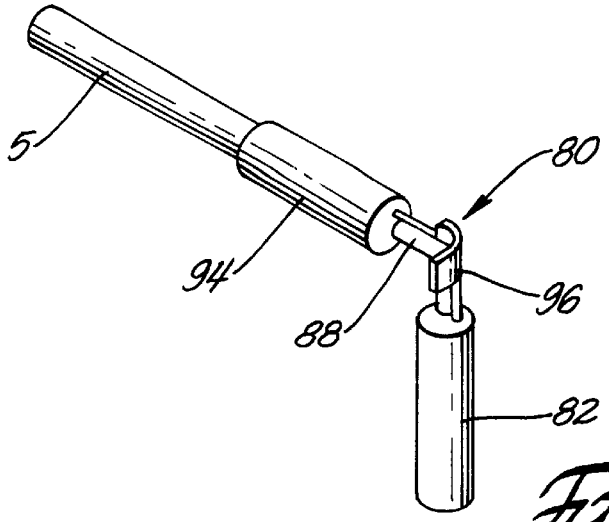
FIG. 7 is a isometric view of a terminal shown in FIG. 1 and shown crimped to a wire.
Figure 8:
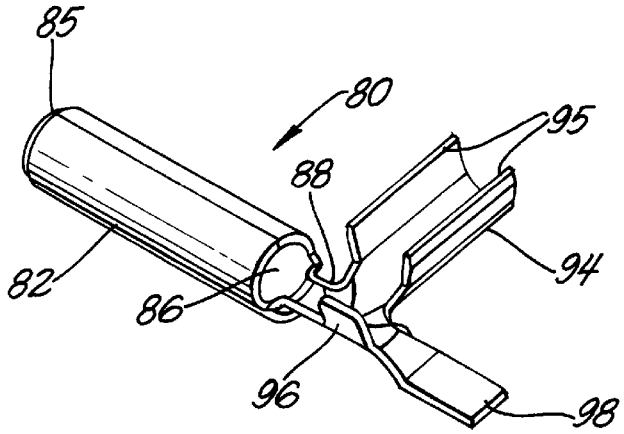
FIG. 8 is a isometric view of the terminal as shown in FIG. 7 prior to crimping.
Figure 9:
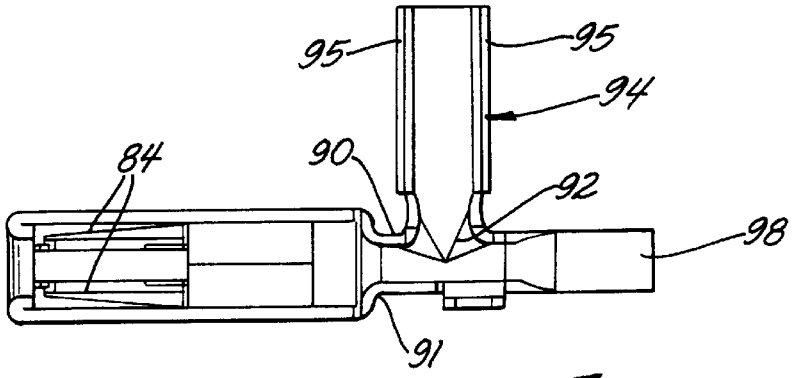
FIG. 9 is a partial section view of the terminal shown in FIG. 8.

Referring now to FIGS. 7, 8, and 9, the terminal 80 for electrical connector 1 is shown in detail. The terminal 80 comprises a barrel portion 82 and a crimp portion 94. The barrel portion 82 is disposed generally perpendicular to the crimp portion 94. The barrel portion 82 has a contact end 85 and an open end 86 that is adjacent to the crimp portion 94. The barrel portion 82 has one or more contacts 84 disposed therein. The barrel portion 82 of the terminal 80 is provided to receive a pin terminal such as one of the pin terminals 64 shown in FIGS. 1 and 2.

The crimp portion 94 is provided to receive and secure the terminal 80 to wire 5. A generally U-shaped transition area 88 is formed between barrel portion 82 and crimp portion 94. Transition area 88 has a smaller diameter section 90, a neck down portion 91 disposed between the open end 86 of the barrel portion 82 and the smaller diameter section 90. A formed transition 92 is disposed between the smaller diameter section 90 and the crimp portion 94. A position tab 96 disposed adjacent to the barrel portion 82 is provided to locate the terminal 80 within an electrical connector (not shown). A carrier strip remnant 98 is at the end of the transition area 88 along the same axis as the barrel portion 82.

The terminal 80 is formed from a unitary piece of metal. The carrier strip remnant 98 is part of a long carrier strip that transports the unitary piece of metal along various sequential manufacturing steps which may include progressive die stations. Furthermore, the carrier strip allows several terminals attached to the carrier strip to be wound on a reel, stored, delivered, and fed to an automatic termination machine. The U-shaped transition area 88 is formed to join the U shaped crimp portion 94, as can be seen in FIG. 8, prior to crimping. The U-shaped transition area 88 allows for a smaller terminal 80 by forming a tighter band. The usual method to achieve a stamped right angle terminal is to provide a flat transition area, which will result in a increase in the overall size of the terminal.

Figure 3:
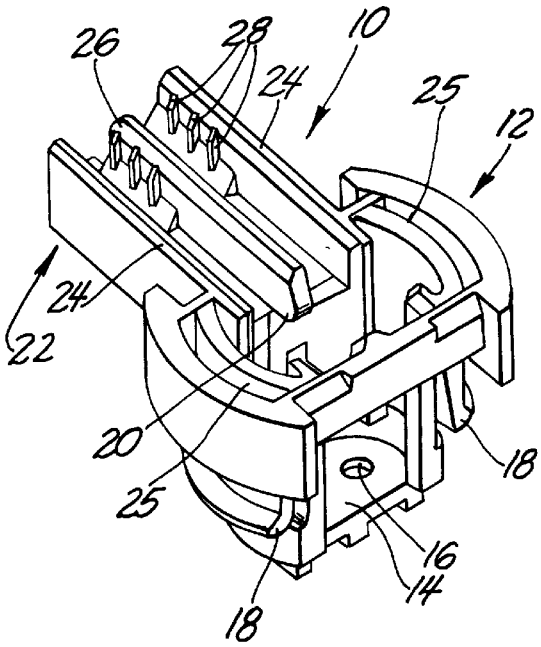
FIG. 3 is an isometric view of a connector housing shown in FIG. 1.

Referring again to FIG. 1 and FIG. 2, the connector 1 of the present invention is assembled by providing a connector housing 10 with a filter cavity 14. The filter element 8 is then disposed within the filter cavity 14 so that receptacles 9 of filter element 8 align with apertures 16. Referring now also to FIG. 3, the connector housing 10 has a filter retaining ridge 20, that prevents the filter 8 from coming dislodged during transport and assembly. A pair of terminals 80 are provided, each of which have a barrel portion 82 which is disposed generally perpendicular to the crimp portion 94. A wire 5 is connected to the crimped portion 94 of each terminal 80. The pair of terminals 80 are inserted into the connector housing 10 so that the barrel portion 82 are inserted into respective receptacles 9 of filter element 8 and the wires 5 are lodged in wire channels 24.

The cover portion 50 of retaining cap 30 is then fastened to the top of connector housing 10. CPA portion 40 is then folded over on top of cover portion 50 so that tabs 44 and 48 extend into the connector housing 10. Connector housing 10 is then plugged into initiator 60 after shorting clip assembly 70 has been installed. Alignment tabs 48 slide into slots 79 to guide connector housing 10 into shorting clip assembly 70 while disengagement tabs 44 push shorting clip 78 away from terminal pins 64.

The foregoing description discloses and describes the various embodiments of the present invention. One skilled in the art will readily recognize from such description, and from the accompanying drawings and claims, that various changes, modifications and variations can be made therein without departing from the spirit and scope of the present invention, and also such modifications, changes and variations are intended to be included within the scope of the following claims.

What is claimed is:

1. An electrical connector for use in a safety restraint system having a controller and an initiator, comprising:

a connector housing having a plug portion with a filter cavity disposed therein;

a pair of apertures extending through a bottom wall of the plug portion into communication with the filter cavity;

a filter element disposed within the filter cavity, the filter element having a pair of longitudinally disposed receptacles extending therethrough, each of the receptacles being aligned with one of the pair of apertures;

a pair of terminals disposed within said connector housing, each of the terminals having a barrel portion disposed generally perpendicular to a crimp portion for receiving a wire leading from the controller; and the barrel portion of each terminal being disposed within one of the receptacles of the filter element whereby each of the barrel portions are aligned with one of the pair of apertures to receive an initiator pin terminal.

2. The electrical connector as defined in claim 1, wherein the connector housing includes a wire shelf portion having a pair of laterally disposed wire channels in communication with the filter cavity for receiving respective ones of a pair of wires attached to the pair of terminals.

3. The electrical connector as defined in claim 2, further comprising a plurality of retaining ribs disposed within each of the pair of wire channels for retaining and strain relieving the pair of wires.

4. The electrical connector as defined in claim 1, further comprising a retaining cap having a connector position assurance (CPA) portion and a cover portion, a plurality of lock arms extending from the cover portion to fasten the retaining cap to the connector housing, the CPA portion being attached to the cover portion by a pair of flexible straps.

5. The electrical connector as defined in claim 4, further comprising a pair of disengagement tabs extending from the CPA portion for disconnecting shorting clip tabs from a pair of initiator pin terminals when the CPA portion is folded over on the top of the cover portion and fastened thereto.

6. A method for assembling an electrical connector for use in a safety restraint system having a controller and an initiator, comprising the steps of:

providing a connector housing having a plug portion with a filter cavity disposed therein, and a pair of apertures extending through a bottom wall of the plug portion into communication with the filter cavity;

inserting a filter element within the filter cavity, the filter element having a pair of longitudinally disposed receptacles extending therethrough, each of the receptacles being aligned with one of the pair of apertures;

providing a pair of terminals having a barrel portion disposed generally perpendicular to a crimp portion;

crimping the crimp portion of each of the pair of terminals to a wire; and inserting the pair of terminals into the connector housing so that the barrel portion of each of the pair of terminals is also inserted into one of the pair of receptacles of the filter element.

7. An electrical connector for use in a safety restraint system, comprising:

a connector housing having a plug portion with a filter cavity disposed therein:

a pair of apertures extending through the plug portion into communication with the filter cavity;

a wire shelf portion having a pair of laterally disposed wire channels in communication with the filter cavity, a filter element disposed within the filter cavity, the filter element having a pair of longitudinally disposed receptacles, each of the receptacles being aligned with one of the pair of apertures;

a pair of terminals disposed within said connector housing, each of the terminals having a barrel portion perpendicular to a crimp portion, the barrel portion being disposed within one of the receptacles within the filter element and the crimp portion being disposed in one of the pair of laterally disposed wire channels, the barrel portions being adapted for receiving an initiator pin terminal, the crimp portion receiving a wire leading from the controller, a retaining cap having a connector position assurance (CPA) portion and a cover portion, a plurality of lock arms extending from the cover portion and fastening the cap to the plug portion of the connector housing, and the CPA portion being attached to the cover portion by at least one flexible strap so that the CPA portion can be folded over on top of the cover portion.

8. The electrical connector as defined in claim 7, further comprising a pair of disengagement tabs extending from the CPA portion into the plug portion of the connector housing when the CPA portion is folded over on top of the cover portion, the disengagement tabs being adapted for disconnecting a shorting clip from a pair of initiator pin terminals when the connector housing is plugged into a shorting clip assembly.

9. The electrical connector as defined in claim 7 further comprising a pair of alignment tabs extending from the CPA portion into the plug portion of the connector housing, the alignment tabs being adapted to guide the connector housing into the shorting clip assembly.

* * * * *